United States Patent [19]

Molitor et al.

[11] 4,412,775

[45] Nov. 1, 1983

[54] VACUUM ASSISTED MACHINE FOR HANDLING ARTICLES

[75] Inventors: Edwin A. Molitor; Norman P. Crowe, both of Clermont; Guy W. Lampe, Hamilton, all of Ohio

[73] Assignee: Multifold-International, Inc., Milford, Ohio

[21] Appl. No.: 356,786

[22] Filed: Mar. 10, 1982

[51] Int. Cl.[3] ..... B66F 11/00

[52] U.S. Cl. ..... 414/626; 414/627

[58] Field of Search ..... 414/627, 626

[56] References Cited

U.S. PATENT DOCUMENTS 3,933,388 1/1976 Conboy ..... 414/627 X

FOREIGN PATENT DOCUMENTS 601002 7/1960 Canada ..... 414/627

1075814 2/1960 Fed. Rep. of Germany ..... 414/627

*Primary Examiner*—Robert J. Spar

*Assistant Examiner*—Donald W. Underwood

*Attorney, Agent, or Firm*—James W. Pearce; Roy F. Schaeperklaus

[57] ABSTRACT

A machine for assisting in the support of a load. A suction head having a downwardly facing opening supports the load. A conduit is connected to the hollow interior of the suction head and suction is impressed on the conduit so that the load can be held at the opening. A cable supports the suction head. A pressure cylinder is provided with a piston connected to urge the cable upwardly to support the suction head and the load. Fluid under pressure can be supplied to the cylinder at two selected pressures, one selected pressure being sufficient to substantially counterbalance the weight of the load and of the suction head, the other selected pressure being a lesser pressure sufficient to substantially counterbalance the weight of the suction head. A pressure operated switch is connected to be actuated by pressure in the conduit. Operation of the switch impresses the first selected pressure on the cylinder when the opening in the suction head is closed by the load and there is a reduced pressure in the conduit. The lesser selected pressure is impressed on the cylinder when the opening in the suction head is free of the load and the suction is released.

5 Claims, 20 Drawing Figures

FIG. 5
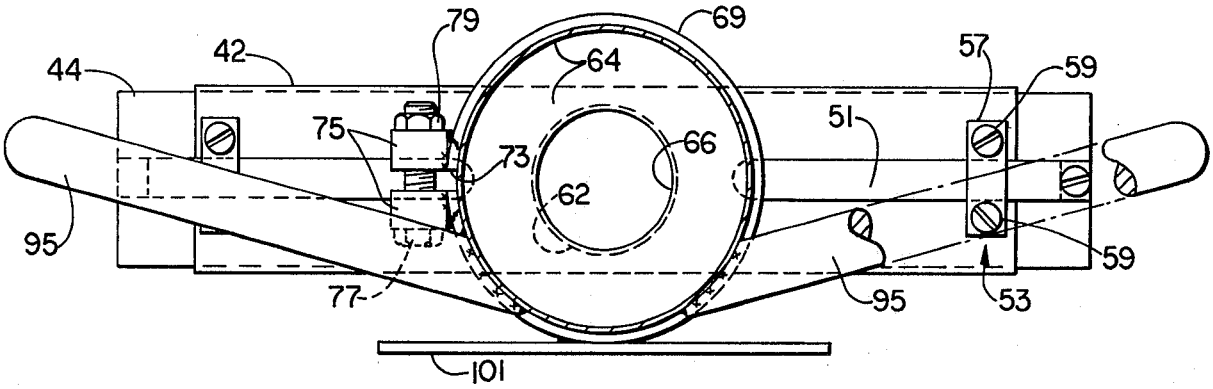
FIG. 6
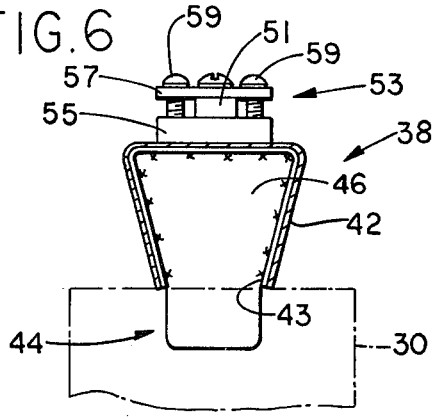
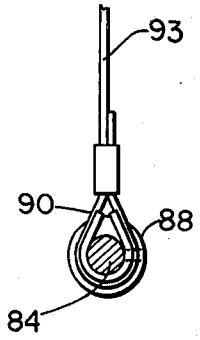
FIG. 7

VACUUM ASSISTED MACHINE FOR HANDLING ARTICLES

This invention relates to a machine for handling articles and stacks of articles. More particularly, this invention relates to a vacuum assisted machine for assisting in the support of articles and stacks of articles.

An object of this invention is to provide a machine which assists in the raising and moving of a load such as an article or a stack of articles so that an operator need not support the entire weight of the load.

A further object of this invention is to provide a machine having a suction head which can support the load and means for urging the suction head upwardly to counterbalance the weight of the load and of the suction head.

A further object of this invention is to provide such a machine in which the means for urging the suction head upwardly includes a cylinder and a fluid urged piston working in the cylinder.

A further object of this invention is to provide such a machine in which means is provided for supplying fluid under pressure to the cylinder at two selected pressures, one selected pressure being sufficient to substantially counterbalance the suction head and the load, the other selected pressure being a lesser pressure and sufficient to substantially counterbalance the suction head alone.

A further object of this invention is to provide such a machine in which there is control means for the pressure supplying means connected to the suction head and controled by the suction therein so that, when the suction head is supporting the load, the greater of the selected pressures is supplied to the cylinder, and when there is no load supported by the suction head, the lesser of the selected pressures is supplied to the cylinder.

Briefly, this invention provides a machine for assisting in the support of a load, which includes a suction head having a hollow interior and a conduit connected to the hollow interior. A suction line of a blower is connected to the conduit. A downwardly facing opening in the suction head receives the load with the load closing the opening and the suction in the suction head supporting the load. A support cable supports the suction head. A piston of a fluid operated cylinder is arranged to urge the support cable upwardly to counterbalance the weight of the suction head and the load. Means is provided to supply fluid to the cylinder at two selected pressures. One selected pressure is sufficient to substantially counterbalance the weight of the load and of the suction head. The other selected pressure is a lesser pressure and is sufficient to substantially counterbalance only the weight of the suction head. A pressure operated switching assembly is connected to the conduit and is arranged to impress the first selected pressure on the cylinder when the opening in the suction head is closed by the load and to impress the lesser selected pressure on the cylinder when the opening in the suction head is free of the load.

The above and other objects and features of the invention will be apparent to those skilled in the art to which this invention pertains from the following detailed description and the drawings, in which:

FIG. 5 is a view in section taken on the line 5—5 in FIG. 2;

FIG. 6 is a view in section taken on the line 6—6 in FIG. 4;

FIG. 7 is a view in section taken on the line 7—7 in FIG. 4;

In the following detailed description and the drawings, like reference characters indicate like parts.

Figure 1:
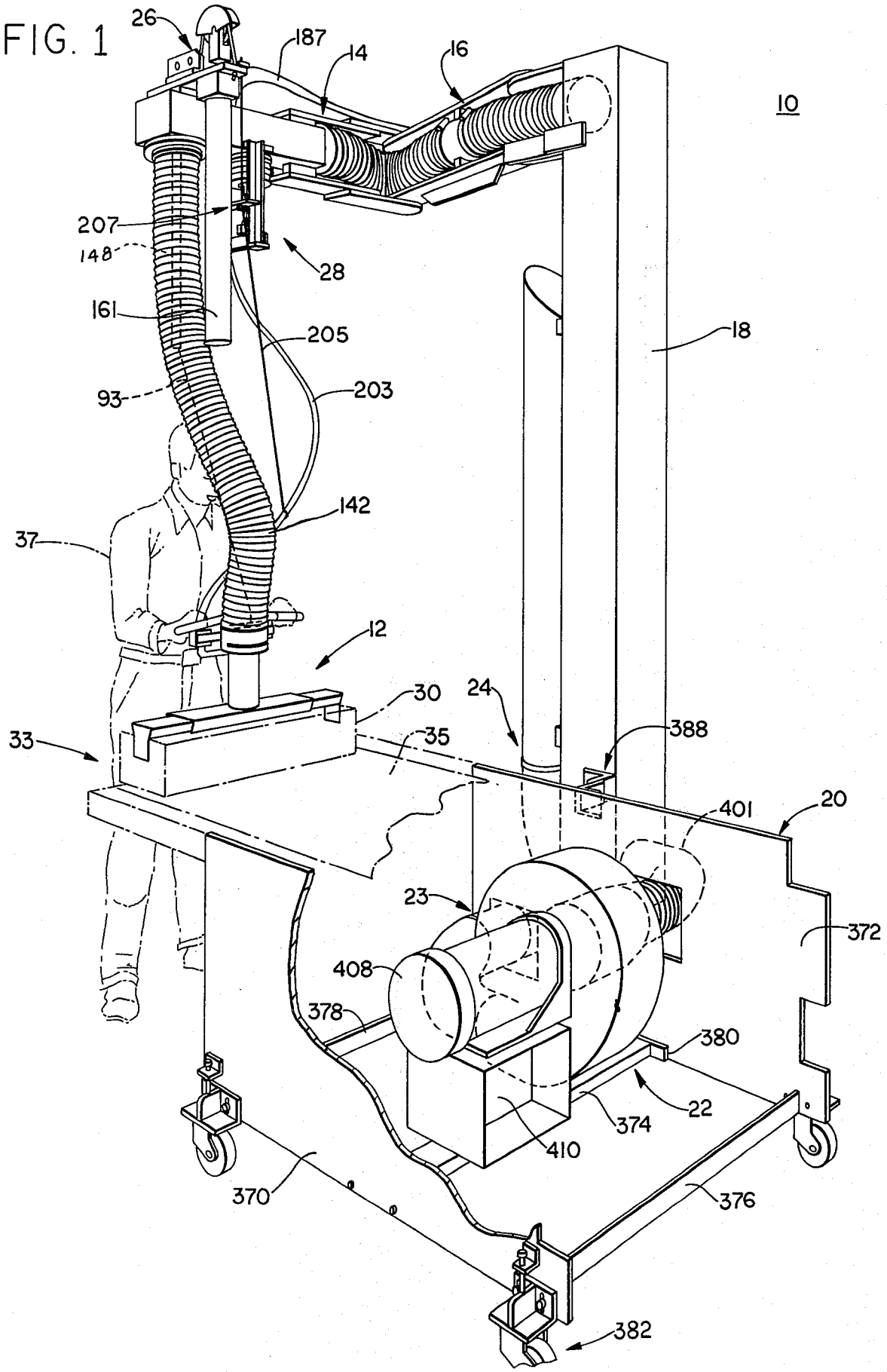
FIG. 1 is a perspective view of a machine for assisting in the support of a load, which is constructed in accordance with an embodiment of this invention, an operator being shown in association therewith, a load being shown in dot-dash lines, parts of the machine being broken away to show internal details.

In FIG. 1 is shown a vacuum assisted material handler 10 that is constructed in accordance with an embodiment of this invention. The vacuum assisted material handler 10 is comprised of a suction head 12, a forearm assembly 14, a primary arm assembly 16, a standpipe 18, a base frame assembly 20, a blower 22, a butterfly valve 23 and an exhaust conduit 24. The forearm assembly 14 also incorporates a counterbalance mechanism 26 and a diaphragm assembly 28.

The vacuum assisted material handler 10 is intended to assist a human operator 37 in the movement of a heavy object or load from one location to another. As such, the machine can be configured to handle many different kinds of objects. In this embodiment, the load can be a slug of cartons 30 that has been produced in automated machinery and conveyed to a pickup station 33 upon a conveyor 35. The slug of cartons 30 can be maintained in composite form by holding means that is specific to the conveyor 35 and is not described herein.

The blower 22 of the vacuum assisted material handler 10 is mounted within the base frame assembly 20 of the conveyor 35, while the butterfly valve 23 is located in the exhaust conduit 24.

GENERAL OPERATION

Figure 2:
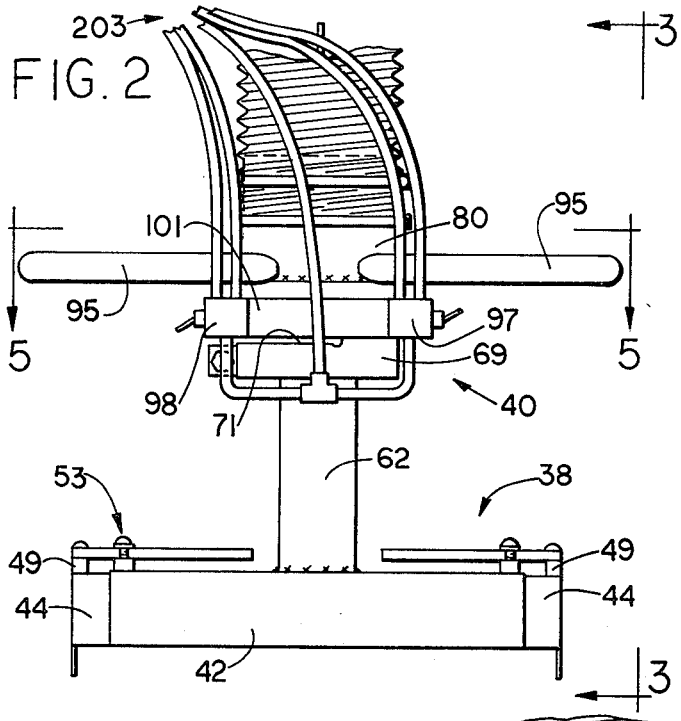
FIG. 2 is a fragmentary view in end elevation of a suction head of the machine and related units.
Figure 3:
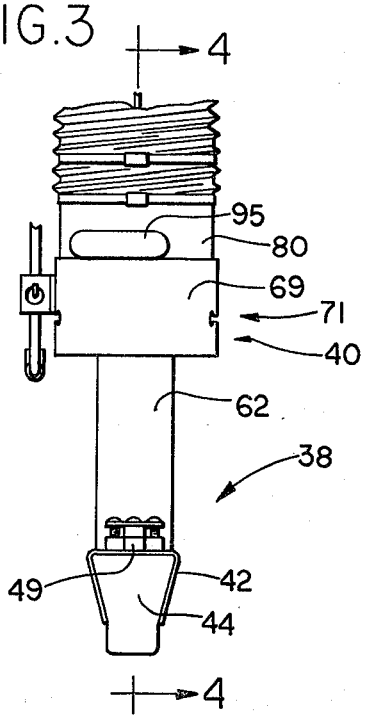
FIG. 3 is a view in side elevation of the suction head looking in the direction of the arrows 3—3 in FIG. 2.
Figure 4:
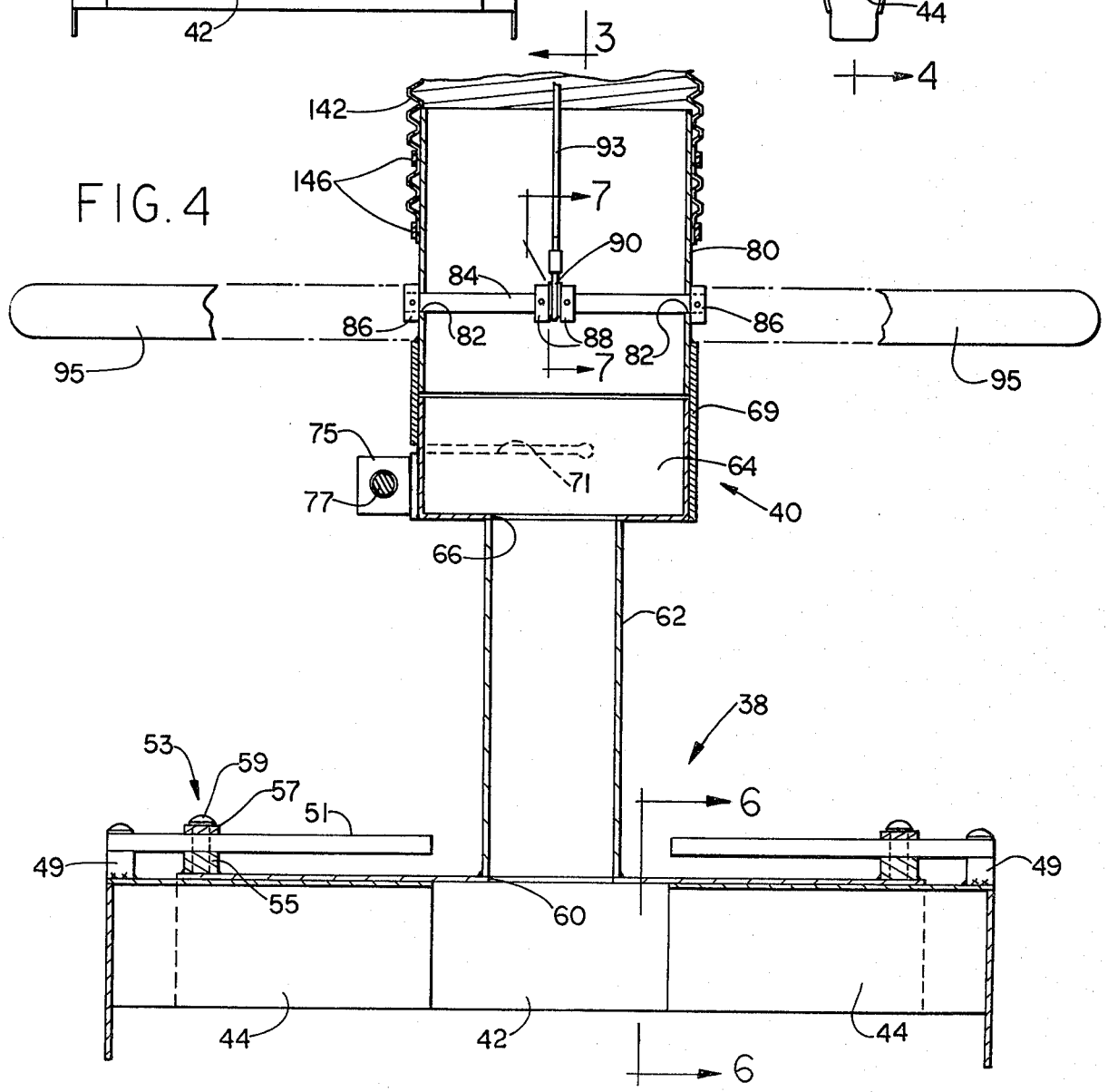
FIG. 4 is a view in section taken on an enlarged scale on the line 4—4 in FIG. 3.

The blower 22 is operated continuously while air flow through the machine is controlled by the normally closed butterfly valve 23. The operator 37 places the suction head 14 upon the top surface of the slug of cartons 30 and makes an on/off control valve or switch 97 (FIG. 2). The control valve 97 actuates a pneumatic circuit that opens the butterfly valve 23. The blower 22, being connected to the suction head 12 by suction air conduits, produces suction therein. Drop in pressure in the forearm assembly 14 contracts the diaphragm assembly 28 that in turn activates the counterbalance mechanism 26. The pre-set counterbalance assembly 26 lifts upwardly upon the suction head 12 by means of an internal cable 93 with such force as to essentially overcome weight of the suction head 12 and the slug of cartons 30. Consequently, the operator 37 is left with little weight to overcome in lifting the slug of cartons 30 off the conveyor 35.

Lateral translation of the slug of cartons 30 is facilitated by the pivoting qualities of the forearm assembly 14 and the primary arm assembly 16. As the operator 37 deposits the slug of cartons 30 at its new location, the on/off control valve 97 is thrown to the off position. This causes closing of the butterfly valve 23 to eliminate the suction on the slug of cartons 30 and the diaphragm assembly 28 to permit the slug to be released and to relax the counterbalance mechanism 26 so that there is no sudden rise of the suction head 12. If for some reason the load being moved is accidentally dislodged from the suction head 12, the loss of suction by the free passage of air through the system will relax the diaphragm assembly 28 and consequently relax the counterbalance mechanism 26 so that there is no sudden upward movement of the suction head 12.

DETAILED DESCRIPTION

Details of construction of the suction head 12 are shown in FIGS. 2–6 inclusive. The suction head 12 incorporates a quick disconnect manifold 38 and a clamp adapter 40. The quick disconnect manifold 38 utilizes a formed outer shell 42 that is essentially an inverted channel whose vertical sides tend to close upon themselves. This formed outer shell 42 functions as a slide channel for extendible ends 44 that are similarly formed and fit closely within the envelope of the formed outer shell 42. An opening 43 between walls of the shell 42 and of the extendible ends 44 receives the slug of cartons 30. The slug of cartons substantially closes the opening 43 with the slug of cartons engaging the suction head 12 at edges of the opening 43. The outer extremity of each extendible end 44 is closed with an end plate 46 that is rigidly affixed along the inside perimeter of the extendible end 44 and extends downwardly somewhat therefrom (FIG. 6). A standoff block 49 is rigidly affixed to the upper surface of, and at the outer end of, each extendible end 44. Fixedly attached to the top of the standoff block 49 and extending inwardly therefrom, is a clamp bar 51 that in turn passes through a clamp 53. Each clamp 53 is comprised of a base 55 and a strap 57. Each base 55 is a rectangular piece that is rigidly affixed to the upper outboard surfaces of the formed outer shell 42 and provides threadable mounting for a pair of screws 59. The screws 59 pass through clear holes in the strap 57 and downwardly past the clamp bar 51 and into the base 55. Thus, the telescoping feature of the formed outer shell 42 and the extendable ends 44, along with the clamp 53 and clamp bar 51, provides an assembly that is quickly but fixedly adjustable in length to cooperate with different sizes of slugs.

The formed outer shell 42 incorporates a centrally located hole 60 in its upper surface. A tube 62 is rigidly affixed at its lower extremity to the top surface of the formed outer shell 42 to cooperate with the hole 60. The upper extremity of the tube 62 is rigidly affixed to the lower surface of a transition adapter 64 (FIG. 4) and similarly cooperates with a hole 66.

The transition adapter 64 fits into a clamp ring 69 that is formed from a continuous tube. A horizontal slot 71 is located toward the lower end of the part and extends approximately 200° around the circumference of the tube. A vertical slot 73 (FIG. 5) severs the lower portion of the tube midway of the slot 71 to give the lower portion of the tube circumferential flexibility. A pair of lugs 75 is rigidly affixed to the outer surface of the lower portion of the tube and adjacent the vertical slot 73. A bolt 77 passes through clear holes in the pair of lugs 75 and with the aid of a nut 79 forms a circumferential clamping means in the lower portion of the tube.

The clamping ring 69 is slipped over the lower end of a hose tube 80 and is rigidly affixed thereto. The hose tube 80 is provided with a pair of holes 82 (FIG. 4) through which a bar 84 passes horizontally. The outer extremities of the bar 84 are fixedly provided with shaft collars 86 which serve to hold the bar 84 in place. A pair of collars 88 (FIG. 7) is narrowly spaced at the center of the bar 84 to laterally contain a cable eye 90 that is supported at the lower extremity of the cable 93. The cable 93 is a part of the counterbalance mechanism 26 and will be further discussed hereinafter. A pair of handles 95 is rigidly affixed to the operator side of the hose tube 80 and vertically located adjacent the clamping ring 69. As can be seen in FIG. 5, the handles are slightly swept away from the operator. The pair of handles 95 is so located to put the operator's thumbs into working relationship with the on/off control valve 97 (FIG. 2) and a compressor control valve 98. These two control valves are fixedly attached to a mount 101 that is in turn rigidly affixed to the upper operator side of the clamp ring 69. As previously indicated, the on/-off control valve 97 serves to actuate the pneumatic circuit that controls the butterfly valve 23 mounted in the exhaust conduit 24 of the blower 22. The compressor control valve 98 operates a pneumatic circuit (not shown in detail) that opens and closes a compressor assembly in proper sequence against the ends of the slug of cartons 30. This compressor assembly is specific to the conveyor 35 and will not be described in detail herein.

Figures 8, 9:
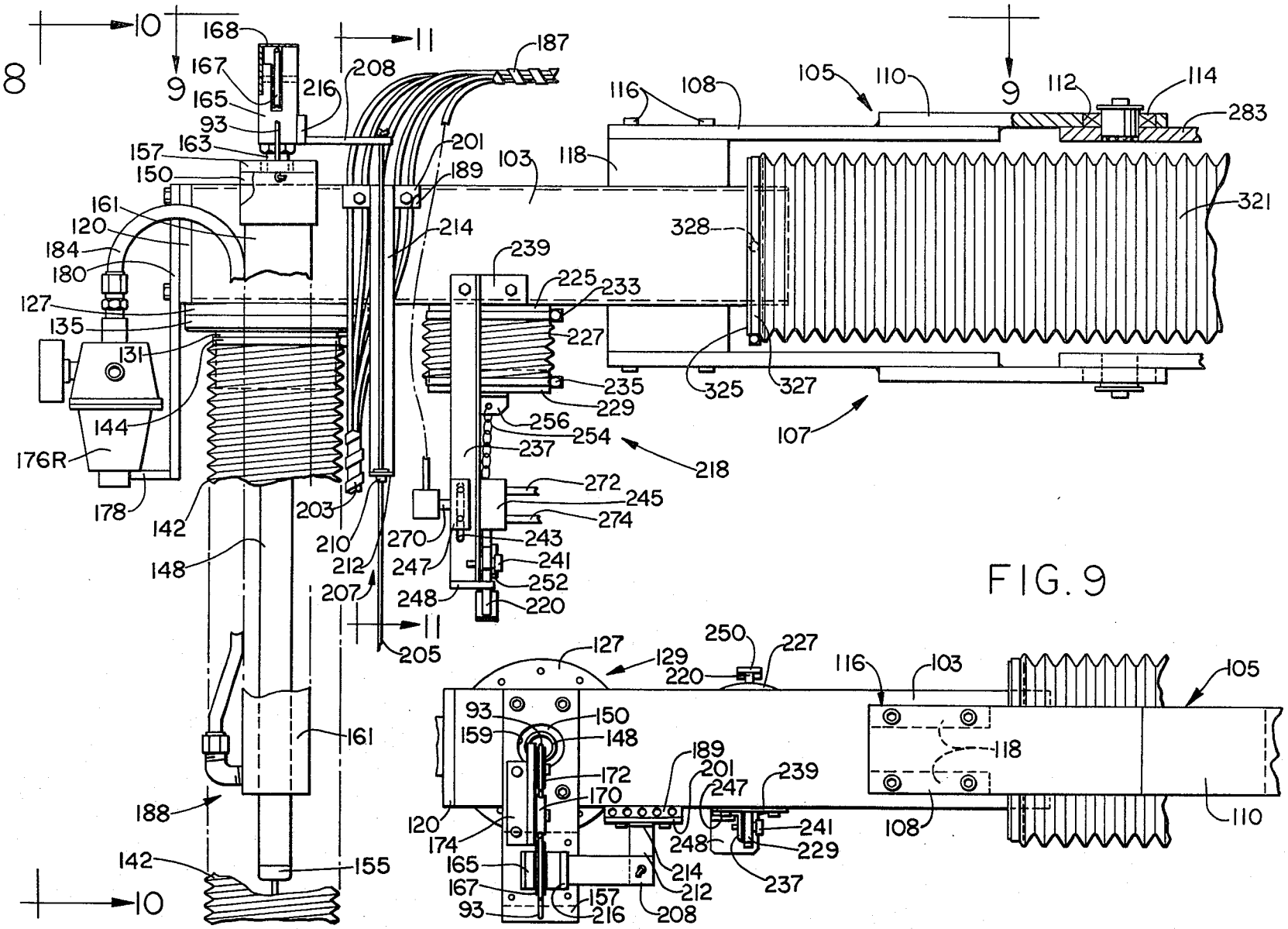
FIG. 8 is a fragmentary view, partly in side elevation and partly in section, of a portion of the machine which supports the suction head and a horizontal support portion thereof.
FIG. 9 is a fragmentary plan view looking in the direction of the arrows 9—9 in FIG. 8.

The forearm assembly 14 is shown in FIGS. 1 and 8–12. The structure of the forearm assembly 14 is comprised of a length of square tube 103, an upper support arm 105 and a lower support arm 107. The upper support arm 105 is further comprised of an arm plate 108 and a pivot plate 110. The arm and pivot plates 108 and 110, respectively, are overlapped, aligned and rigidly affixed to each other to form the upper support arm 105. The right hand end of the pivot plate 110 incorporates a clear bore 112 into which a radial ball bearing 114 is pressed. A set of four bolts 116 pass through clear holes in the left end of the arm plate 108 and threadably mount into the top of a pair of standoffs 118. The standoffs 118 in turn are rigidly affixed to the square tube 103. The lower support arm 107 and its attachment to the square tube 103 is identical to the upper support arm 107, except that the lower support arm 107 is inverted to form a cooperating pair. The left extremity of the square tube 103, as shown in FIG. 8, is closed by an end plate 120 that is rigidly affixed thereto.

Figure 12:
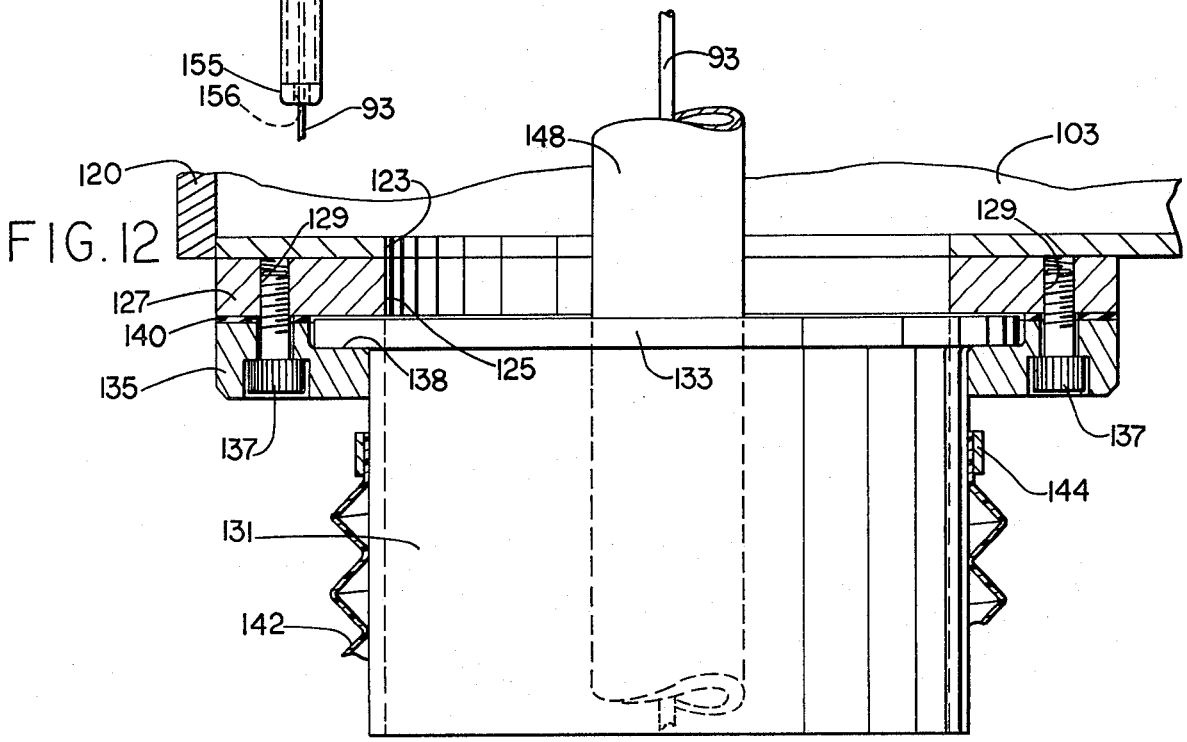
FIG. 12 is a fragmentary view in upright section on an enlarged scale of a portion of the support structure shown in FIG. 8.

As can be seen in FIG. 12, a hole 123 is provided in the bottom surface of and near the left end of the square tube 103. The hole 123 communicates directly with a hole 125 in a mounting ring 127 that is rigidly affixed to the bottom surface of the square tube 103. The mounting ring 127 is provided with a pattern of threaded holes 129 around its face. A swivel connector 131, exhibiting an external flange 133 at its upper end is placed against the bottom surface of the mounting ring 127 so that the hole 125 communicates with the inside diameter thereof. The swivel connector 131 is captured in place by a retaining ring 135 and is left free to pivot by virtue of a counterbore 138 that is formed in the top surface of the ring 135. A gasket 140 is utilized between the mounting ring 127 and the retaining ring 135 to prevent air leakage between these parts. The retaining ring 135 is fixedly held in place by a set of bolts 137 that cooperate with the pattern of threaded holes 129 in the mounting ring 127. A fairly heavy lubricant is placed in the counterbore 138 of the retaining ring 135 to facilitate pivotal motion of the swivel connector 131 and to prevent air leakage around the external flange 133.

A flexible hose 142 (FIG. 8) is placed over the downwardly extending portion of the swivel connector 131 and is clampedly attached thereto by a hose clamp 144. The flexible hose 142 extends downwardly to slide over the upwardly extending portion of the hose tube 80 (FIGS. 4 and 1) of the suction head 12 to which it is clampedly attached by a pair of hose clamps 146.

Figure 10:
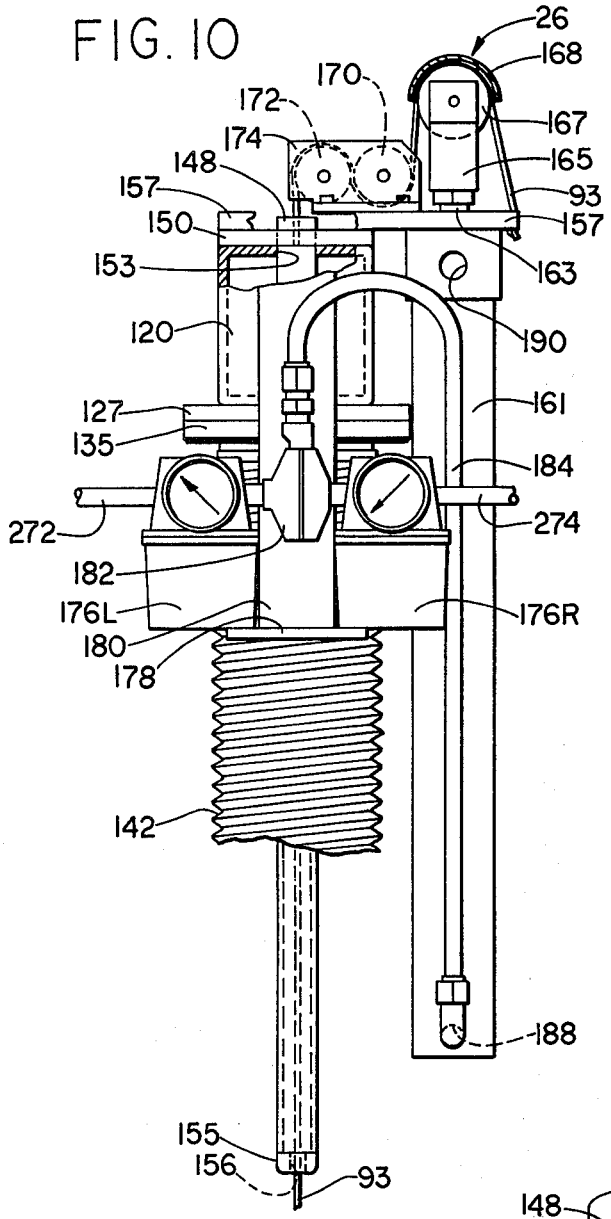
FIG. 10 is a view in end elevation looking in the direction of the arrows 10—10 in FIG. 8.

Referring again to FIGS. 8, 9 and 10, a follower tube 148, located near the left end of the square tube 103, is rigidly affixed at its upper end through the center of a tube mount plate 150. The follower tube 148 is then inserted through a hole 153 in the top surface of the square tube 103, the hole 153 being placed on the same vertical centerline as the hole 123 in the bottom surface of the square tube 103. The follower tube 148 is held in the square tube 103 by rigidly affixing the table mount plate 150 to the top surface thereof. Consequently, the follower tube 148 extends substantially downward into the confines of the flexible hose 142, as can be seen in FIG. 1. The lower extremity of the follower tube 148 rigidly incorporates a cable bushing 155, as is best shown in FIG. 10, providing an opening 156 of just sufficient size to permit passage of the cable 93 without substantial loss of suction. As was discussed with respect to FIG. 7, the cable 93 is attached within the suction head 12. The cable rises vertically up through the flexible hose 142, through the cable bushing 155 and into the follower tube 148. The cable 93 exits the top of the follower tube 148 and is attached to and controlled by the counterbalance mechanism 26. Therefore, as the operator 37 moves the suction head 12 laterally, a horizontal force is applied at the bottom of the follower tube 148 by means of the cable 93. This horizontal force will cause the forearm assembly 14 and the primary arm assembly 16 to pivot, thus causing the free end of the forearm assembly 14 to take a position approximately above the suction head 12. It can be said that the working end of the arm assemblies will follow the suction head 12, always placing the overhead mechanism at a predictable and expected location.

The counterbalance mechanism 26 is shown in FIGS. 8, 9 and 10. A counterbalance base 157 is fixedly attached atop the tube mount plate 150 and extends outboardly therefrom. An access hole 159 provides clearance for the protruding upper end of the follower tube 148 and its associated weld and the passage of the cable 93. The outboard end of the counterbalance base provides mounting for a cylinder 161 that is fixedly attached to the underside thereof. A cylinder rod 163 of the cylinder 161 extends upwardly through a clear hole in the counterbalance base 157 and fixedly accommodates a rod clevis 165. The rod clevis 165 rotatably accommodates a cylinder pulley 167 between its tines. In viewing FIG. 8, the right hand tine of the rod clevis 165 is extended upwardly to a point slightly above the cylinder pulley 167 to provide mounting for a pulley cover 168. The pulley cover 168 is closely fit to the cable 93, thus functioning as a cable retainer.

The upper extremity of the cable 93 passes downwardly through a clear hole in the outboard extremity of the counterbalance base 157 where it is "tied off", thus anchoring it firmly therein. The cable 93 passes upwardly and over the cylinder pulley 167, downwardly and around an idler pulley 170, then upwardly and over a second idler pulley 172 and into the follower tube 148. The idler pulley 170 and the second idler pulley 172 are rotatably mounted upon short cantilever shafts that are in turn threadably mounted into the vertical member of a pulley mount 174. The pulley mount 174 is an L-shaped bracket whose horizontal member is fixedly attached to the top surface of the counterbalance base 157. The vertical member of the pulley mount 174 slightly overhangs the follower tube 148, such that the cable 93 descends along the centerline thereof. A cable retainer for the idler pully 172, similar in construction to the pulley cover 168 of the cylinder pulley 167, can be provided but is not shown in the drawings.

Referring again to FIGS. 8 and 10, two adjustable relieving pressure regulators 176L and 176R are fixedly mounted to a mount plate 178 that is in turn rigidly affixed to the lower front surface of a hanger plate 180. The hanger plate 180 rises vertically to be fixedly attached to the front surface of the end plate 120 of the square tube 103. Output lines of the pressure regulators are fixedly attached to a dual check valve 182 leading to a supply line 184 of the cylinder 161. The cylinder 161 is a single acting cylinder with its supply orifice 188 at the bottom and its vent orifice 190 at the top. When pressure is applied, the cylinder extends upwardly. When pressure is not supplied, the piston and cylinder rod 163 can retract downwardly. With this arrangement, the right hand pressure regulator 176R, as shown in FIG. 10, can be set at a rather low value, pressuring the cylinder 161 sufficiently to counterbalance only the weight of the suction head 12. The left hand pressure regulator can then be set at a much higher pressure to counterbalance the combined weights of the suction head 12 and a slug of cartons 30. The low pressure regulator 176R and the high pressure regulator 176L are turned on and off by means of the diaphragm assembly 28 to be discussed hereinafter.

Figure 11:
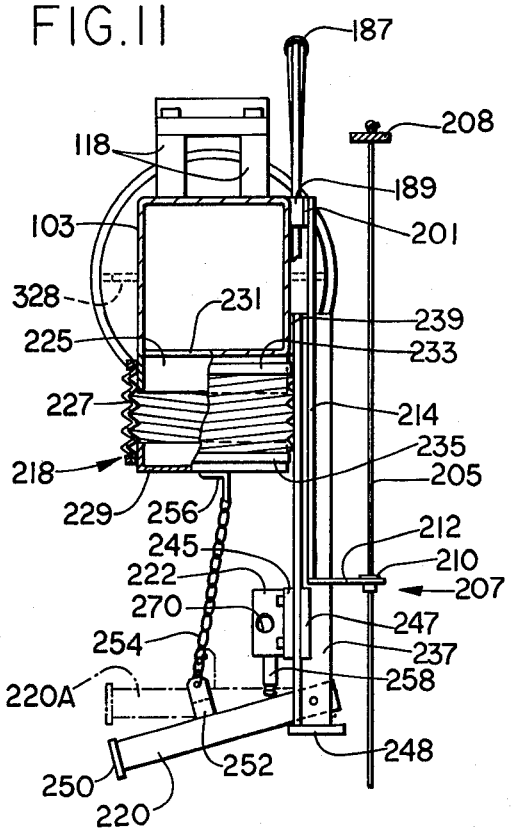
FIG. 11 is a view in section taken on the line 11—11 in FIG. 8.

Referring now to FIGS. 8, 9 and 11, a bundle of air lines 187 enters a manifold block 189 that is in turn fixedly clamped between the side of the square tube 103 and a cover plate 201. The air lines exit the manifold block 189 downwardly and are collected again into a bundle of lines 203. These air lines descend downwardly and are mechanically attached to the on/off switch 97 and the compressor switch 98 of the suction head assembly 12, as is shown in FIGS. 1 and 2. The length of the bundle of lines 203 must be such to permit the suction head 12 to reach its lowest level. When the operator lifts a slug of cartons 30, the bundle of line 203 has to be tethered to prevent it from interfering with the operation of the machine. A tether line 205 (FIG. 1) is attached to the bundle of lines 203 at an appropriate point and rises generally upward to pass through a line guide 207 and then vertically to be attached to a tether anchor 208. The line guide 207 incorporates a flange bushing 210 pressed into a clear hole at the unsupported end of a horizontal member 212 that is in turn rigidly affixed in cantilever form to the bottom extremity of a guide hanger 214. The upper end of the guide hanger 214 is rigidy affixed to the outer surface of the cover plate 201 of the manifold block 189. The tether anchor 208 is rigidly affixed in cantilever form to the lower right hand surface of a mount foot 216 that is in turn fixedly attached to the lower right hand surface of the rod clevis 165. Consequently, as the cylinder 161 extends upwardly in response to the raising of the suction head 12, the tether line 205 is also raised as is the lower portion of the bundle of lines 203.

The diaphragm assembly 28 is shown in FIGS. 8–11, and is comprised of a diaphragm 218, a gravity arm 220 and a pneumatic switch 222.

The diaphragm 218 is further comprised of an adapter ring 225, a hose 227, and a pan 229. The adapter ring 225 is rigidly affixed to the bottom surface of and approximately at the center of the length of the square tube 103 of the forearm assembly 14 to communicate with a hole 231 therein (FIG. 11). The hose 227 is placed over the adapter ring 225 and is fixedly held thereupon by a hose clamp 233. The lower end of the hose 227 is placed over the side of the pan 229 and fixedly held in place by means of a hose clamp 235. In this manner, a sensitive and powerful pressure sensing device has been constructed owing to the large area of the pan 229 and the flexibility of the hose 227.

The gravity arm 220 is pivotally mounted from the lower end of a hanger mount 237 that is constructed from a length of structural angle. The upper end of the hanger mount 237 is rigidly affixed to the left side of an attachment plate 239 that is in turn fixedly attached to the lower portion of a side of the square tube 103 adjacent the diaphragm 218. The lower portion of the outwardly extending flange of the hanger mount 237 incorporates a threaded bore for the attachment of shoulder bolt 241. Also, the lower portion of the flange parallel to the square tube 103 incorporates a slot 243 for the adjustable attachment of a switch mount plate 245 by means of a pair of bolts and a nut plate 247. A stop plate 248 is rigidy affixed to the lower extremity of the hanger mount 237.

Figure 20:
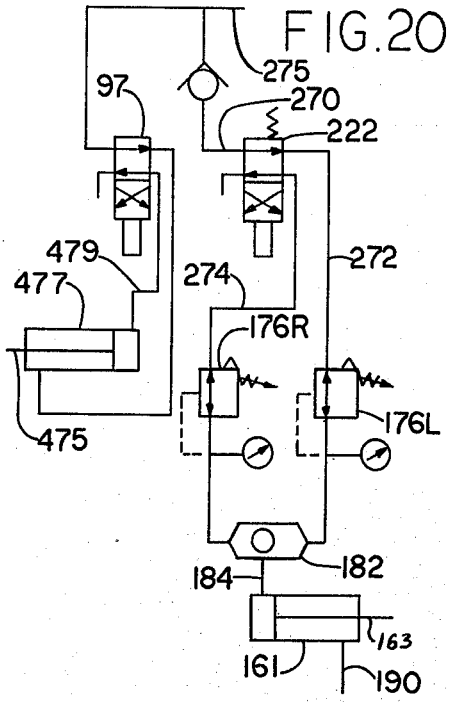
FIG. 20 is a schematic view of pneumatic connections of the machine.

The gravity arm 220 is a length of bar stock that is provided with a clear bore and flange bushing at its right end (FIG. 11), and is pivotally mounted upon the shoulder bolt 241. The left extremity of the gravity arm 220 is provided with an end plate 250 rigidly affixed thereto. A yoke member 252 is rigidly affixed upon the top surface of an approximately at the center span of the gravity arm 220 such that the tines of the yoke member 252 extend upwardly. The lower end of a chain 254 is attached between the tines of the yoke member 252 by means of a pin, while the upper end of the chain 254 is attached to an angle bracket 256 that is in turn fixedly attached to the underside of the pan 229. The gravity arm 220 points downwardly until it rests upon the extended edge of the stop plate 248. In this rest position, the chain 254 exerts no substantial downward load upon the diaphragm 218. When the air pressure drops in the square tube 103, the pan 229 of the diaphragm 218 is drawn upward quickly and forcefully, thus raising the gravity arm 220 to a position 220A (FIG. 11). In this position, the gravity arm depresses a plunger 258 of the pneumatic switch 222 that is in turn fixedly attached to the switch mount plate 245. The pneumatic switch 222 receives full pressure air through its air input 270 and delivers full pressure air through output lines 272 and 274. The air input 270 receives air under pressure from a line 275 (FIG. 20). The output line 272 is connected to pressure regulator 176L, and the output line 274 is connected to pressure regulator 176R. Thus, when the diaphragm 218 is activated by a drop of air pressure in the system, the pneumatic switch 222 delivers high pressure air to pressure regulator 176L, and when vacuum is absent, the gravity arm 220 releases the plunger 258 so that high pressure air is delivered to the pressure regulator 176R. The left end of the gravity arm 220 is provided with the end plate 250 to facilitate the addition of suitable inverted U-shaped weights (not shown) to the arm. The additional weights can be used to shorten the response time of the diaphragm assembly 28.

Figure 13:
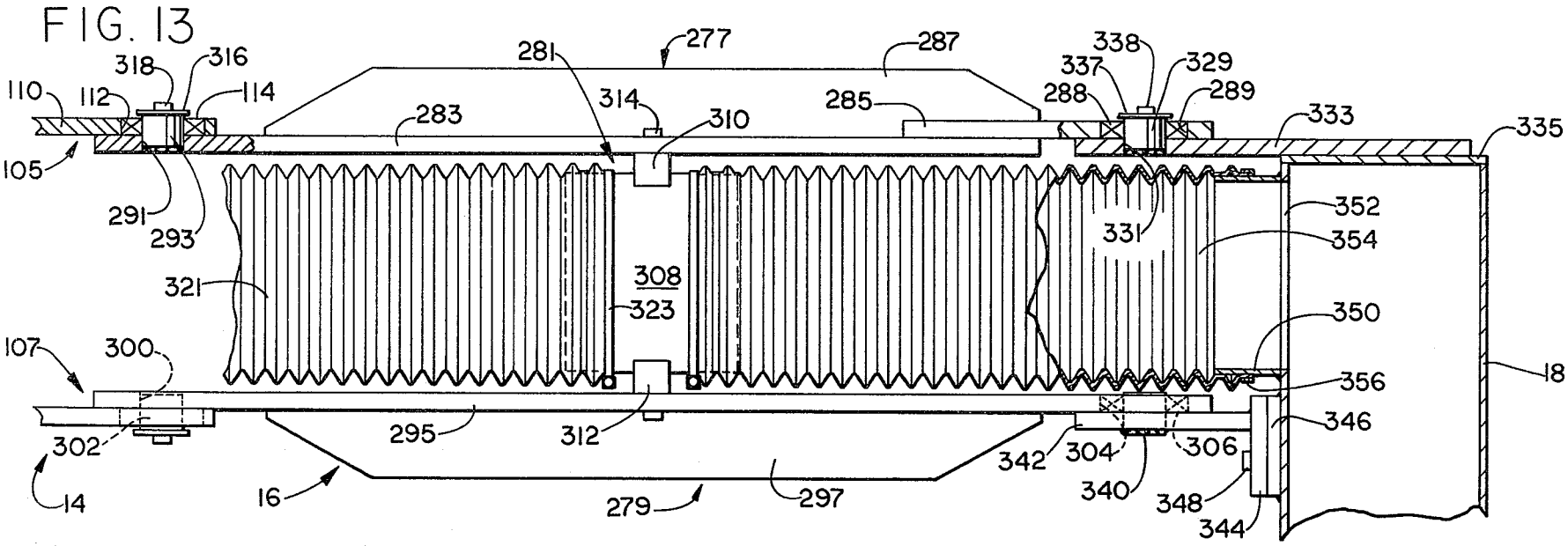
FIG. 13 is a fragmentary view, partly in section and partly in side elevation of a primary arm assembly of the machine.
Figure 14:
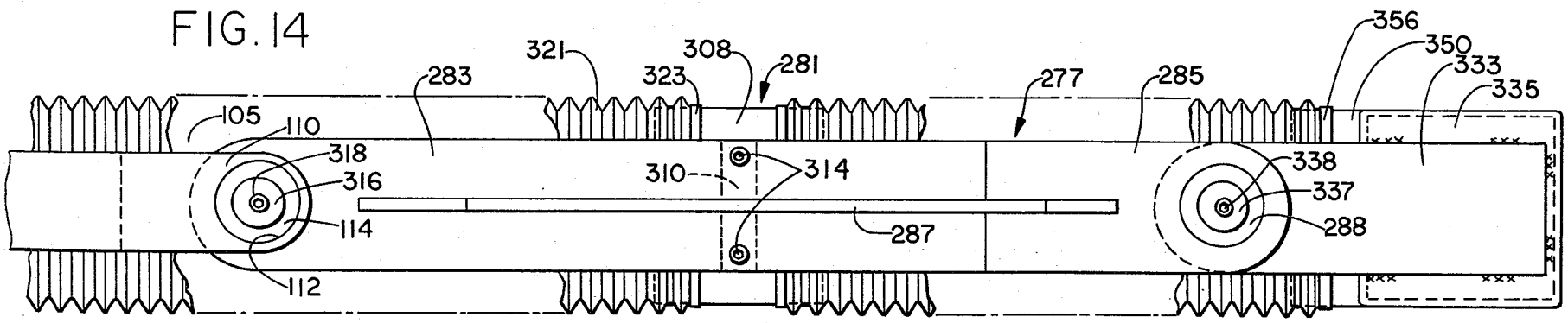
FIG. 14 is a plan view of the primary arm assembly shown in FIG. 13.

The primary arm assembly 16 is shown in FIGS. 1, 13 and 14 and is comprised of an upper arm weldment 277, a lower arm weldment 279, and a hose anchor 281.

The upper arm weldment 277 is further comprised of an arm plate 283, a bearing plate 285, and a stiffener 287. The bearing plate 285 is provided with a clear bore 289 through its right end into which is pressed a radial ball bearing 288. The left end of the bearing plate 285 is rigidly affixed in overlapped fashion to the right hand upper surface of the arm plate 283. The left end of the arm plate 283 is provided with a clear bore 291 into which is rigidly affixed a shaft 293 that extends upwardly. The lower edge of the stiffener 287 is rigidly affixed to the top surfaces of the arm plate 283 and the bearing plate 285, thus making the upper arm weldment 277 quite rigid.

The lower arm weldment 279 is further comprised of a lower arm plate 295 and a stiffener 297. The upper edge of the stiffener 297 is rigidly affixed to the bottom surface of the lower armplate 295 to stiffen it. The left end of the lower arm plate 295 is provided with a clear bore 300 into which is rigidly affixed a short shaft 302 that extends downwardly. The right end of the lower arm plate 295 is provided with a clear bore 304 into which is pressed a radial ball bearing 306.

The hose anchor 281 is further comprised of a short tube 308, an upper anchor bar 310 and a lower anchor bar 312. The bottom surface of the upper anchor bar 310 is concave to cooperate with the outer diameter of the short tube 308 in order to facilitate rigidly affixing it thereto. The top surface of the lower anchor bar 312 is likewise concave to facilitate rigid attachment to the bottom of the short tube 308. The upper arm weldment 277 and the lower arm weldment 279 are held in parallel spaced relationship by fixedy attaching the hose anchor 281 therebetween. A pair of bolts 314 passes through clear holes near the center span of the upper arm weldment to threadably mount into the upper anchor bar 310. The lower arm weldment 279 is attached in a similar manner to the lower anchor bar 312 of the hose anchor 281.

The forearm assembly 14 is pivotally attached to the left end of the primary arm assembly 16. The shaft 293 of the upper arm weldment of the primary arm assembly 16 passes through the inner race of the radial ball bearing 114 of the upper support arm 105 of the forearm assembly 14. The bearing 114 is retained on the shaft 293 by a retainer disc 316 and a screw 318. The screw 318 passes through a clear hole in the retainer disc 316 and threadably mounts into the end of the shaft 293. Likewise, the short shaft 302 is retained in the bearing of the lower support arm 107 of the forearm assembly 14.

A flexible hose 321 connects the hose anchor 281 with the open right end of the square tube 103 (FIG. 8). The right end of the flexible hose 321 is placed over the left end of the short tube 308 of the hose anchor 281 and is clampedly held thereupon by a hose clamp 323. The left end of the flexible hose 321 is placed over the outer diameter of an adapter disc 325 and is clampedly held thereupon by a hose clamp 327. The adapter disc 325 incorporates a square hole through its center, such that it fits closely around the outer perimeter of the square tube 103. It is fixedly held in place by a pair of set screws 328. The set screws 328 pass radially inward through the adapter disc and bear against the outside surface of the square tube 103.

The right end of the primary arm assembly 16 is pivotaly mounted to the upper end of the standpipe 18. Referring again to FIGS. 13 and 14, the radial ball bearing 288 of the upper arm weldment 277 is fitted upon a short shaft 329 that is in turn rigidly affixed in a clear bore 331 of a top pivot plate 333. The top pivot plate 333 is the same width as the bearing plate 285 of the upper arm weldment 277 and is rigidly affixed in cantilever form upon the top surface of a cap plate 335 that is in turn rigidly affixed to the top extremity of the standpipe 18. The bearing 288 is retained upon the short shaft 329 by a retainer disc 337 and a screw 338. The screw 338 passes through a clear hole in the retainer disc 337 and threadably mounts into the end of the short shaft 329.

The radial ball bearing 306 of the lower arm weldment 279 is fitted upon a short shaft 340 that is in turn rigidly affixed through a clear bore in a lower pivot plate 342. The lower pivot plate 342 is the same plan form as the upper pivot plate 333, except that it is foreshortened. The foreshortened end is rigidly affixed across the upper face of a mounting bracket 344. The mounting bracket 344 is fixedly attached to a mounting pad 346 by a pair of bolts 348. The mounting pad 346 is rigidly affixed to the side of the standpipe 18. Because of the fixed parallel and spaced relationship between the upper and lower arm weldments 277 and 279, respectively, the lower bearing 306 does not require a retainer.

A hose adapter 350 is rigidly affixed to the side of the standpipe 18 between the top pivot plate 333 and the mounting pad 346 to communicate directly with a circular hole 352 therein. The right end of a flexible hose 354 is placed over the hose adapter 350 and clampedy held in place by a hose clamp 356. The left end of the flexible hose 354 is clampedly attached to the right end of the short tube 308 in a similar manner.

Figure 15:
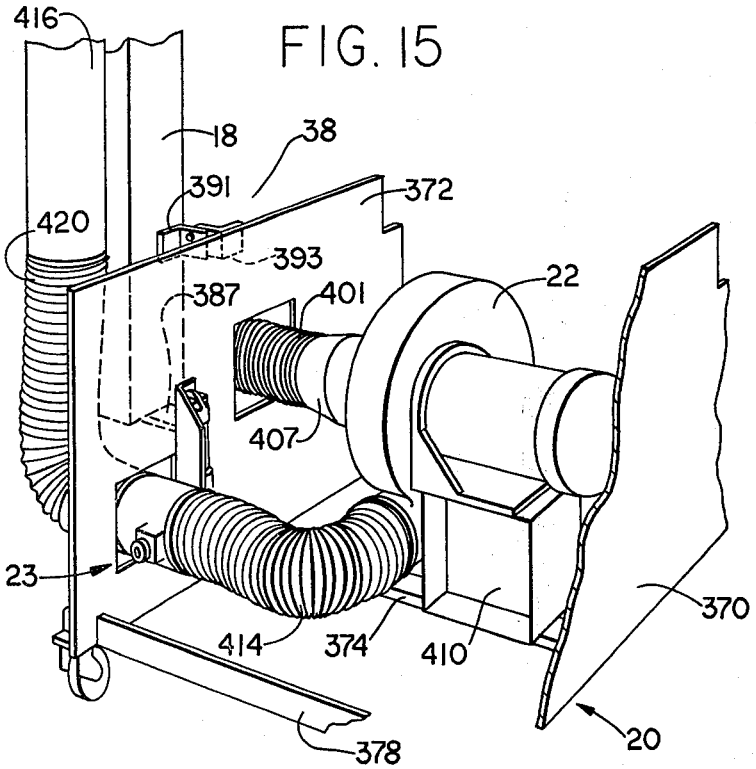
FIG. 15 is a fragmentary perspective view of a base frame assembly of the machine.
Figure 16:
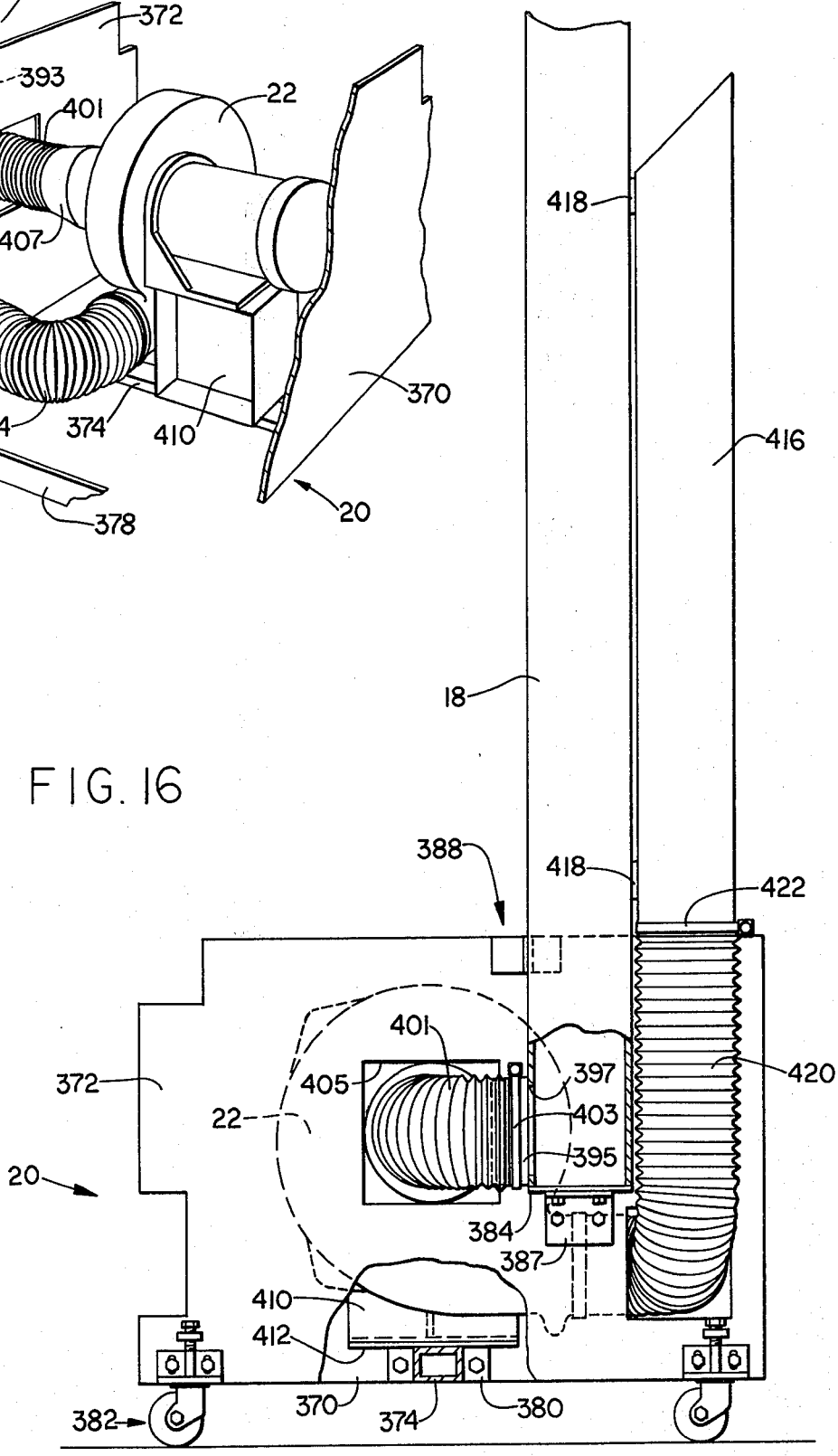
FIG. 16 is a view in end elevation of the base frame assembly.

The standpipe 18 extends downwardly to be fixedly attached to the side of the base frame assembly 20 as is best shown in FIGS. 1, 15 and 16. The base frame 20 is comprised of a right side plate 370, a left side plate 372, a mid-lateral brace 374, an input bar 376, and an output bar 378. The right side plate 370 and the left side plate 372 are held in upright spaced and parallel relationship by the input and output bars 376 and 378 and by the mid-lateral brace 374. End plates 380 are rigidly affixed to the ends of the mid-lateral brace 374 to facilitate fixed attachment to the side plates 370 and 372 from the inside of the base frame assembly 20. Vertically adjustable caster assemblies 382 are fixedly attached at corners of the base frame assembly 20.

The bottom end of the standpipe 18 is closed by a bottom plate 384 that is rigidly affixed thereto. An angle mount 387 is fixedly attached to the bottom surface of the bottom plate 384. A downwardly extending vertical flange of the angle mount 387 is fixedly attached to the outboard surface of the left side plate 372. The standpipe 18 is stabilized in vertical disposition by an upper attachment 388 that is comprised of a pipe angle member 391 ad a base angle member 393. The pipe angle member 391 is rigidly affixed to the right side of the standpipe 18 (FIG. 15) so that its lateral flange extends toward and cooperates with the lateral flange of the base angle member 393, that is in turn rigidly afffixed to the outboard surface of, and adjacent the top edge of, the left side plate 372. The two lateral flanges of the members 391 and 393 are fixedly attached to each other by a pair of bolts and nuts that aid in the assembly of the machine. A hose adapter 395 is rigidly affixed to one side of a lower end portion of the standpipe 18 and communicates with a circular hole 397 therein, as is shown in FIG. 16.

A flexible hose 401 in placed over the hose adapter 395 and clampedly attached thereto by a hose clamp 403. The flexible hose 401 turns through a right angle in the horizontal plane to pass through a square hole 405 in the left side plate 372. After passing through the square hole 405, the flexible hose 401 is clampedly attached to the small end of a transition member 407. The large end of the transition member 407 is fixedly attached to the air inlet of the blower 22. The blower 22 is driven by a motor 408 that is in turn fixedly mounted atop a motor stand 410. The motor stand 410 is fixedly attached to a blower mount plate 412 that is in turn rigidly affixed across the top surface of the mid-lateral brace 374.

Another length of flexible hose 414 is clampedly attached in the same way as previously described to the exhaust port of the blower 22. The flexible hose 414 makes a right angle turn to communicate with the inflow side of the butterfly valve 23 to be discussed hereinafter. An exhaust stack 416 is fixedly attached to the side of the standpipe 18 as is shown in FIG. 16. A pair of mounting blocks 418 is rigidly affixed to the output surface of the standpipe 18, one at the top edge of the exhaust stack 416 and the other near the bottom thereof. Screws (not shown) pass through clear holes in the exhaust stack 416 from the inside out to threadably mount in the pair of mounting blocks 418. A length of flexible hose 420 is clampedly attached around the bottom end of the exhaust stack 416 by means of a hose clamp 422. The flexible hose 420 extends downwardly and makes a right angle turn in a transverse plane to be fixedly clamped to the output side of the butterfly valve 23.

Figure 17:
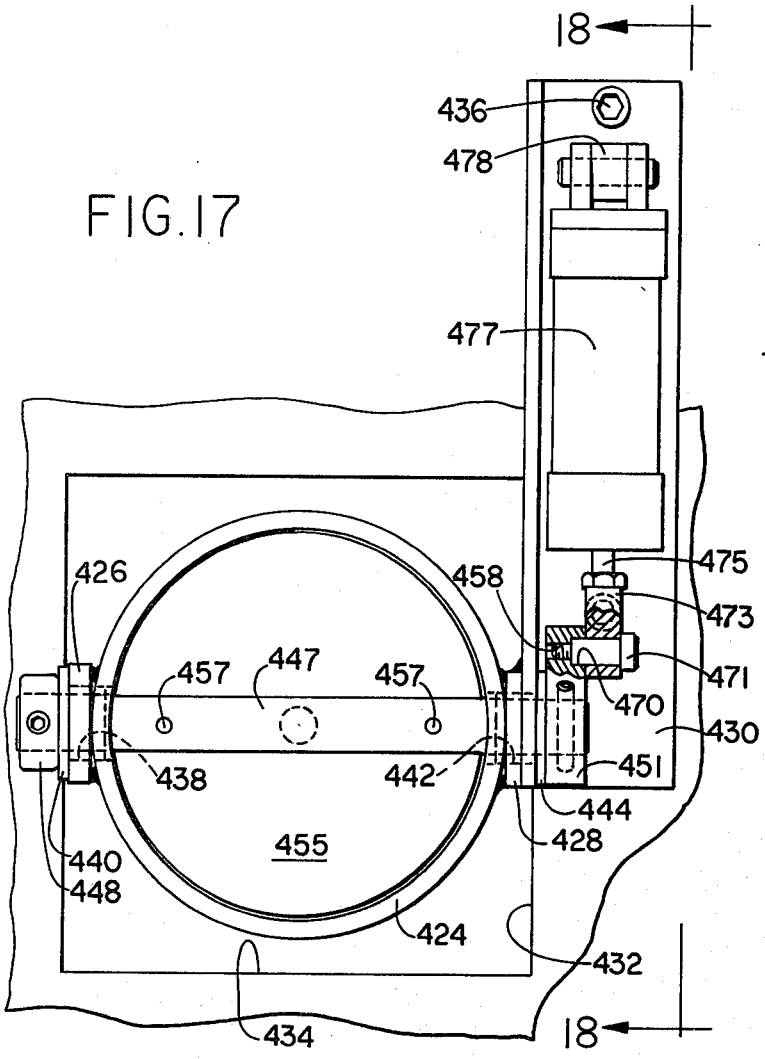
FIG. 17 is a fragmentary view in end elevation of a valve assembly of the machine.
Figure 19:
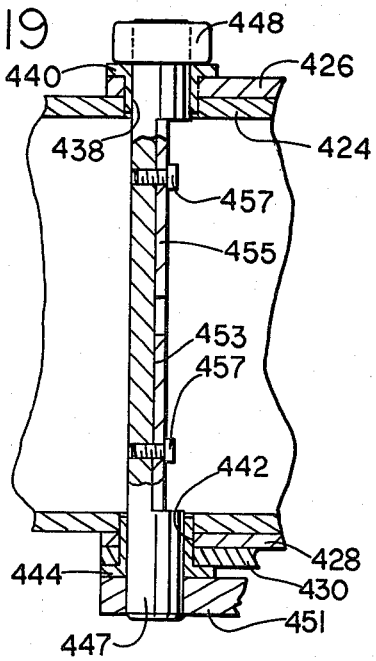
FIG. 19 is a view in section taken on the line 19—19 in FIG. 18.
Figure 18:
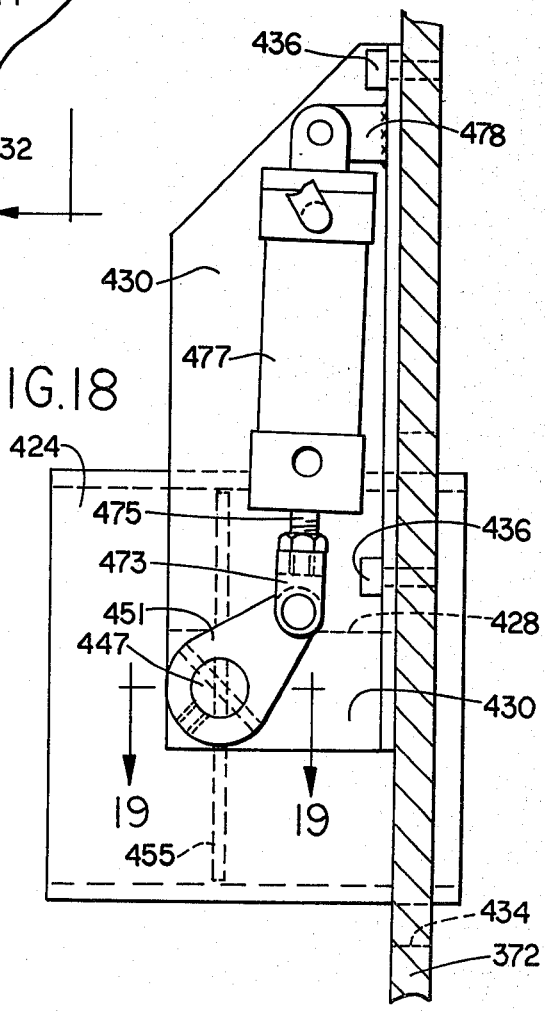
FIG. 18 is a view in section taken on the line 18—18 in FIG. 17.

The butterfly valve 23 is shown in FIGS. 17 and 19. The supporting structure of the assembly is comprised of a tubular body 424, a bearing spacer 426, a mounting spacer 428, and a mounting angle 430. The bearing spacer 426 is rigidly affixed to the left side (FIG. 17) of the tubular body 424 and the mounting spacer 428 is rigidly affixed to the right side of the body 424. The lower end of the mounting angle 430 is rigidly affixed to the outer surface of the mounting spacer 428, thereby positioning one leg of the mounting angle 430 parallel to the centerline of the tubular body 424, and the other leg lying transversely therewith and extending outwardly therefrom. The transverse leg of the mounting angle 430 is fixedly attached to the inboard surface of the left side plate 372 and adjacent to a right hand edge 432 of a square cutout 434 therein. A pair of screws 436 passes through clear holes in the transverse leg of the mounting angle 430 to threadably mount in the left side plate 372. A clear bore 438 is provided through the bearing spacer 426 and the left wall of the tubular body 424, the combined thickness of these parts being sufficient to receive a flange bearing 440. Similarly, a clear bore 442 is provided through the right side wall of the tubular body 424, the mounting spacer 428 and the parallel leg of the mounting angle 430. The combined thickness of these parts is sufficient to receive a flange bearing 444. A valve shaft 447 pivotally cooperates with the flange bearings 440 and 444, and is held in lateral place by a shaft collar 448 fixedly attached to the left end thereof, and an operator arm 451 that is fixedly attached to the right end thereof. Referring to FIG. 19, the central portion of the valve shaft 447 exhibits a cutout 453 that permits a valve plate 455 to reside on the centerline of the valve shaft 447. The valve plate 455 is fixedly attached to the valve shaft by a pair of bolts 457. The bolts 457 pass through clear holes in the valve plate 455 and threadably mount in the valve shaft 447. The working end of the operator arm 451 is provided with a threaded hole 458 and a counterbore 470 that enters into the outside surface thereof. A shoulder bolt 471 is threadaby mounted therein, exposing just enough shoulder length to pivotally accommodate a rod end 473. The rod end 473 is fixedly attached to the working end of a cylinder rod 475 of a valve cylinder 477. The base of the valve cylinder 477 is pivotally mounted to the end of a cylinder lug 478 that is in turn rigidly affixed to the upper face of the transverse flange of the mounting angle 430.

When the operator 37 makes the on/off control valve 97 (FIG. 20), pressure from the air pressure line 275 is directed along a line 479 to cause extension of the cylinder rod 475 of the valve cylinder 477 so that the valve plate 455 pivots through an arc of 90°. The valve plate 455 will remain in the horizontal position as long as pressure is applied through the line 479 to the valve cylinder 477. When the control valve 97 is moved to the position shown in FIG. 20, the cylinder rod 475 of the valve cylinder 477 returns the valve plate to the closed position.

When the machine is to be used and the slug of cartons 30 is at the position shown in FIG. 1, the pneumatic switch 222 is at its other position (FIG. 20) and air under pressure from the air input 270 is directed through the low pressure regulator 176R (FIG. 20) to the cylinder 161 to cause upward pressure by the cylinder pulley 167 on the cable 93 of sufficient force to substantially counterbalance the weight of the suction head 12 so that the suction head can be moved conveniently to be placed in association with the slug of cartons 30 as shown in FIG. 1. The on/off control valve 97 (FIG. 20) is advanced to its other position to cause extension of the cylinder rod 475 and opening of the butterfly valve 23 so that a vacuum is impressed by the blower 22 on the interior of the suction head 12 to hold the slug of cartons 30 in association with the suction head 12. Suction in the interior of the square tube 103 causes raising of the pan 229 and actuation of the pneumatic switch 222 to cause advance of the pneumatic switch 222 to the position shown in FIG. 20 to direct air under pressure through the high pressure regulator 176L to the cylinder 161 to cause upward pressure of the cylinder pulley 167 on the cable 93 of sufficient force to substantially counterbalance the weight of the slug of cartons 30 and the suction head 12 so that the head 12 and the slug 30 can readily be raised and moved to a new position. When the head 12 and the slug 30 are at the new position, the on/off control valve 97 can be returned to the position shown to permit closing of the butterfly valve 23 and release of the suction in the suction head 12 so that the suction head can be raised from the slug of cartons 30. When the suction is released, the pneumatic switch 222 returns to its other position as shown in FIG. 20 at which the pressure on the cylinder 161 is sufficient to substantially counterbalance the weight of the suction head 12.

The machine illustrated in the drawings and described above is subject to structural modification without departing from the spirit and scope of the appended claims.

Having described our invention, what we claim as new and desire to secure by Letters Patent is:

1. A machine for assisting in the support of a load which comprises a suction head having a hollow interior, a conduit connected to the hollow interior, means for impressing suction on the conduit, there being a downwardly facing opening in the suction head, the opening being arranged to receive the load with the load closing the opening and the load engaging the head at the opening, cable means supporting the suction head, a pressure cylinder having a piston connected to urge the cable means upwardly to support the suction head and the load, means for supplying fluid under pressure to the pressure cylinder at two selected pressures, one selected pressure being sufficient to substantially counterbalance the weight of the load and of the suction head, the other selected pressure being a lesser pressure sufficient to substantially counterbalance the weight of the suction head, a pressure operated switch connected to the conduit and arranged to impress the first selected pressure on the pressure cylinder when the opening in the suction head is closed by the load and there is a reduced pressure in the conduit and to impress the lesser selected pressure on the pressure cylinder when the opening in the suction head is free of the load and the suction is released.

2. A machine for assisting in the support of a load as in claim 1 in which the conduit includes an expandible portion extending upwardly from the suction head and a chamber at the upper end of the upwardly extending expandible portion, the cable means extends upwardly from the suction head inside the upwardly extending expandible portion and through an opening in a wall of the chamber and the cylinder is disposed outside the conduit.

3. A machine for assisting in the support of a load as in claim 1 in which the means for impressing a suction on the conduit includes a blower having an intake connected to the conduit and an outlet, valve means for closing the outlet, and control means mounted on the suction head and operable by an operator at an operator station adjacent the suction head to selectively open and close the valve means to selectively impress the suction on the suction head.

4. A machine for assisting in the support of a load as in claim 2 which includes an elongated substantially horizontal support arm for the chamber and means for supporting the support arm remote from the chamber for swinging about an upright axis, whereby the suction head and the load can be swung horizontally.

5. A machine as in claim 2 which includes a follower tube attached to the chamber at the opening in the wall of the chamber and extending from the chamber lengthwise of and inside the expandible portion of the conduit, the cable means extending lengthwise of and inside the follower tube, and a bushing means in the follower tube surrounding the cable means to prevent loss of suction surrounding the cable means.

* * * * *